US007185386B2

(12) United States Patent
Segrea

(10) Patent No.: US 7,185,386 B2
(45) Date of Patent: Mar. 6, 2007

(54) PAINTBRUSH WITH INTERCHANGEABLE BRISTLE HEAD

(75) Inventor: Geronimo Segrea, Oakville (CA)

(73) Assignee: Yubany Rodriguez Gradalle, Ontario (CA)

( * ) Notice: Subject to any disclaimer, the term of this patent is extended or adjusted under 35 U.S.C. 154(b) by 51 days.

(21) Appl. No.: 10/795,360

(22) Filed: Mar. 9, 2004

(65) Prior Publication Data

US 2005/0198759 A1 Sep. 15, 2005

(51) Int. Cl.
*A46B 5/00* (2006.01)
*A46B 15/00* (2006.01)

(52) U.S. Cl. ..... 15/106; 15/105; 15/143.1; 15/176.1; 15/176.6; 206/361

(58) Field of Classification Search ..... 15/143.1, 15/176.1, 176.4, 176.5, 176.6, 244.1, 114, 15/145, 184, 210.1, 257.01, 257.05, 105, 15/106; 206/361
See application file for complete search history.

(56) References Cited

U.S. PATENT DOCUMENTS 1,063,523 A * 6/1913 Parrar ..... 15/167.1
1,727,007 A * 9/1929 Eyster ..... 132/313
1,874,467 A * 8/1932 Doll ..... 15/167.1
2,799,883 A * 7/1957 Brady ..... 15/184
2,803,029 A * 8/1957 Brady ..... 15/184
2,854,684 A * 10/1958 Hardman et al. ..... 15/193
2,869,168 A * 1/1959 Morneault ..... 401/18
3,130,433 A * 4/1964 John ..... 401/261
4,283,809 A * 8/1981 Prost ..... 15/145
4,494,268 A * 1/1985 Chu ..... 15/176.1
4,543,679 A * 10/1985 Rosofsky et al. ..... 15/110
5,359,749 A * 11/1994 Chu ..... 15/176.1
5,491,863 A * 2/1996 Dunn ..... 15/106
5,842,784 A * 12/1998 Contrasto ..... 366/129
5,993,560 A * 11/1999 Wasak et al. ..... 134/6
6,145,151 A * 11/2000 Herron et al. ..... 15/143.1
6,230,357 B1 * 5/2001 Davis ..... 15/176.3
6,510,578 B1 * 1/2003 Cyr et al. ..... 15/176.6
2001/0054211 A1 * 12/2001 Cabedo-Deslierres et al. ..... 15/106
2003/0217424 A1 * 11/2003 Stone ..... 15/176.2
2004/0205917 A1 * 10/2004 Wang ..... 15/176.1

FOREIGN PATENT DOCUMENTS

EP 0 068 347 * 1/1983

* cited by examiner

*Primary Examiner*—Randall Chin
(74) *Attorney, Agent, or Firm*—Ingrid E. Schmidt

(57) ABSTRACT

A paintbrush has a handle separable from a bristle head so that different bristle heads may easily be interchanged for different painting applications or used without a handle. The handle is also hollow and stores a sash brush for detail use. A cleaning wand is provided to clean the handle cavity for storing the said brush.

1 Claim, 1 Drawing Sheet

26
60
58
30
56

50
54
52
$w_2$ 26
22
32
34
24
46
20
42

26
22
30
28
32
34
35
48
38
24
46
20
42
44
40
36
$w_1$
$l$ 64
66
62

PAINTBRUSH WITH INTERCHANGEABLE BRISTLE HEAD

FIELD OF INVENTION

The invention relates to a paintbrush for applying paint, varnish or other liquid coatings to a surface, the paintbrush being provided with a handle and a bristle head.

BACKGROUND OF THE INVENTION

The proper application of paint to obtain full surface coverage requires time to prepare the surface being painted and a selection of tools appropriate to the task being done. For a professional painter, time must be used wisely and for the do-it-yourself home renovator, convenience is necessary to achieve the desired result with a minimum of frustration and messiness.

An object of this invention is to provide a multi-purpose paintbrush which obviates the need for a plurality of painting tools.

SUMMARY OF THE INVENTION

In accordance with this invention, there is provided a paintbrush having a handle and at least one bristle head, the at least one bristle head being separable from the handle and adapted to be coupled to the handle for use with the handle.

The invention also provides for the paintbrush to include more than one bristle head, the bristle heads being of different size and interchangeable for use with the same handle.

In a preferred embodiment of the invention, the paintbrush handle is hollow and is adapted to slidingly receive a small detail brush or so-called sash brush. Most preferably, a cleaning wand is provided for cleaning a cavity formed inside the handle for receiving the small detail brush.

BRIEF DESCRIPTION OF THE DRAWINGS

In order to better understand the invention, a preferred embodiment is described below with reference to the accompanying drawings, in which.

DESCRIPTION OF PREFERRED EMBODIMENT WITH REFERENCE TO THE DRAWINGS

Figures 1, 2, 3, 4, 5:
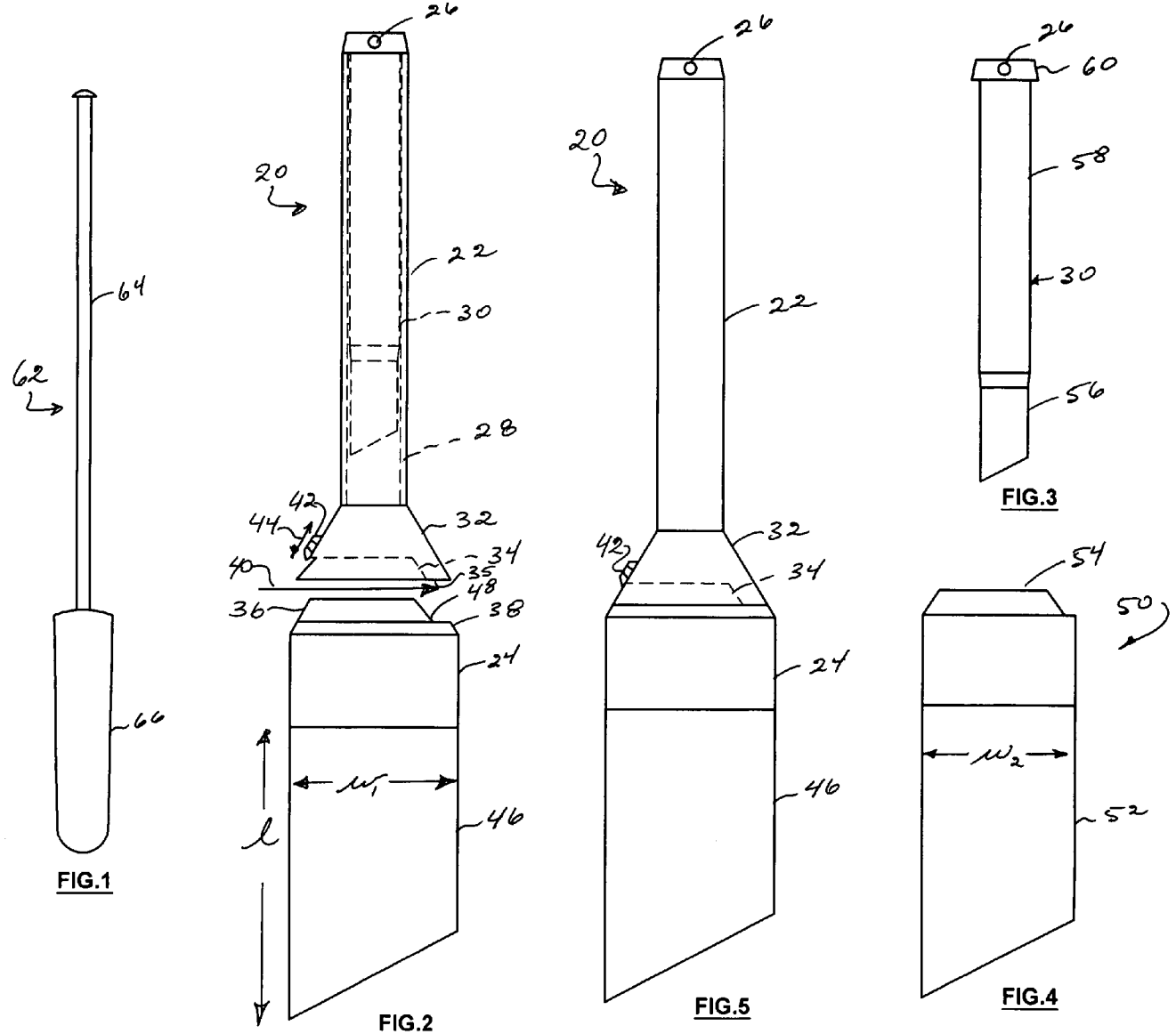
FIG. 1 is a side elevation view of a cleaning wand which forms part of the invention.
FIG. 2 is a side elevation view of a paintbrush made in accordance with the invention with a handle separated from a bristle head.
FIG. 3 is a side elevation view of a detail brush forming part of the invention.
FIG. 4 is a side elevation view of a bristle head of different size than the bristle head of FIG. 2.
FIG. 5 is a side elevation view similar to FIG. 2 showing the handle attached to the bristle head.

A paintbrush made in accordance with the invention is generally indicated in the drawings by reference numeral 20. It will be seen that the paintbrush includes a handle 22 and a bristle head 24 separable from the handle. The handle 22 has an upper end, as drawn, which has a through hole 26 for hanging the paintbrush 20 from a nail or hook (not shown).

The handle 22 is generally cylindrical and elongate and defines a cavity 28 indicated in chain dotted outline. The cavity 28 slidingly receives a small detail brush or sash brush 30 which will be described in more detail with reference to FIG. 3.

The bottom end of the handle 22, as drawn, is flared outwardly to define a first coupling portion 32 for attachment to the bristle head 24. The coupling portion 32, in the embodiment shown, has a slot 34 of truncated conical shape formed therein with an access opening on one side of the paint brush 20 and an end wall 35 on the opposite side of the paint brush.

The top end of the bristle head 24, as drawn, has a truncated conical projection 36 formed on a second coupling portion 38 which is congruent with the slot 34. The conical projection 36 is adapted to be slidingly received in the first coupling portion 32 as indicated by arrow 40 in order to mate with the internal surface of the slot 34. A button 42 slidingly disposed on the first coupling portion 32 is adapted to partially obscure the slot 34 and to retain the bristle head 24 in the attached configuration shown in FIG. 5. The motion of the button 42 on the surface of the first coupling portion 32 is indicated by arrow 44.

The bristle head 24 secures a plurality of bristles 46 in conventional fashion. The bristles 46 are shown collectively and are not drawn individually to simplify the drawings.

It will be noted that the bristles 46 are disposed side-by-side to define a paintbrush width $W_1$ or size which will correspond to the paint stroke applied to a surface being painted. Also, the length l of the bristles 46 varies across the width $W_1$ of the bristle head 24 such that longer bristles are formed on one side corresponding to the open end of the slot 34 and shorter bristles are formed on the opposite side of the bristle head.

Thus in the embodiment shown, where the second coupling portion 38 formed in the bristle head 24 is asymmetrical, the projection 36 is associated with the side of the bristle head 24 that has longer bristles and a shoulder 48 is formed on the opposite side from the projection 36 to receive and support the end wall 35. When the paintbrush 20 is used sideways, the load of the brush will rest on the end wall 35 which will block the projection 36 and minimize accidental separation of the handle 22 from the bristle head 24.

A second bristle head 50 having a different bristle width $W_2$ is drawn in FIG. 4 and is interchangeable with the bristle head 24. The width $W_2$ of its bristles 52 is selected to be narrower than the width $W_1$, and is suitable for different applications than the bristle head 24. It has a respective coupling portion 54 which defines a projection that likewise is slidingly received in the slot 34 formed in the coupling portion 32 of the handle 22.

For still more detail work, a very narrow sash brush 30 may be used. Conveniently the sash brush 30 is dimensioned to be received in the cavity 28 formed in the cylindrical handle 22. The sash brush 30 is shown in more detail in FIG. 3 and has a bristle head 56 at one end which has a predefined small size commensurate with the diameter for a handle 58 which is elongate and cylindrical in shape. The upper end of the handle 58, as drawn, remote from the bristle head 56, has a transversely extending cap 60 with an external diameter greater than the internal diameter of the cavity 28.

Conveniently, a cleaning wand 62 is included with the paint brush 20 and consists of a longitudinally extending post 64 having an absorbent pad 66 attached to the post 64 at one end. The pad 66 will, in use, be dipped in a solvent and inserted into the cavity 28 for cleaning same.

In use, the paint brush 20 may be used in the assembled configuration shown in FIG. 5 or separated to use the bristle head 24 or the bristle head 50 without the handle 22, as required by the nature of the painting job. Alternatively, the sash brush 30 may be used. Conveniently, all the tools required to make a professional paint job are readily available in one assembly.

It will be understood that several variations may be made to the above-described embodiment of the invention within the scope of the appended claims. As will be appreciated by those skilled in the art, the means provided for coupling the handle to the bristle head may vary considerably and the above-described embodiment should be considered merely as illustrative of one way to do this. It will also be understood that several bristle heads may be provided with the paint brush, that the bristle heads may have similar sizes or different sizes and that they may be sold separately from the handle.

The invention claimed is:

1. A paintbrush kit having the following separate and distinct components:

a handle, a plurality of interchangeable bristle heads each adapted to be coupled to the handle, a sash brush and a cleaning wand, the bristle heads having different bristle sizes, each bristle head being separable from the handle and adapted to be coupled to the handle for use with the handle, the handle being hollow and defining a sash brush cavity receiving and storing the sash brush, and the cleaning wand being adapted for insertion into the sash brush cavity, the cleaning wand having a longitudinally extending post and an absorbent pad fixed to the post at one end for cleaning said sash brush cavity, the pad being inserted into the sash brush cavity during cleaning of the sash brush cavity after the sash brush has been used.

* * * * *